US009770912B2

(12) United States Patent
Rittgers et al.

(10) Patent No.: US 9,770,912 B2
(45) Date of Patent: Sep. 26, 2017

(54) INK CARTRIDGE

(75) Inventors: Jon Rittgers, Celbridge (IE); Eduardo Macias, Clonee Meath (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 2429 days.

(21) Appl. No.: 12/065,252

(22) PCT Filed: Oct. 14, 2005

(86) PCT No.: PCT/EP2005/055266

§ 371 (c)(1),
(2), (4) Date: Jul. 22, 2008

(87) PCT Pub. No.: WO2007/042080

PCT Pub. Date: Apr. 19, 2007

(65) Prior Publication Data

US 2009/0219354 A1 Sep. 3, 2009

(51) Int. Cl.
*B41J 2/175* (2006.01)

(52) U.S. Cl.
CPC ..... *B41J 2/17513* (2013.01)

(58) Field of Classification Search
None
See application file for complete search history.

(56) References Cited

U.S. PATENT DOCUMENTS 5,113,199 A * 5/1992 Chan et al. ..... 347/87
5,969,739 A * 10/1999 Altendorf et al. ..... 347/87
5,971,530 A 10/1999 Hashimoto
6,137,512 A * 10/2000 Higuma et al. ..... 347/86
6,183,071 B1 * 2/2001 Sugimoto et al. ..... 347/85
6,286,921 B1 * 9/2001 Ochi et al. ..... 347/7
6,467,890 B1 10/2002 Tajima
2003/0128259 A1 7/2003 Leibman
2011/0094922 A1 * 4/2011 Carew ..... 206/524.6

OTHER PUBLICATIONS

International Search Report for PCT Application No. PCT/EP2005/055266. Report Issued Aug. 21, 2006.
English translation of First Office Action issued by State Intellectual Property Office, P.R. China. Date of issue Jul. 24, 2009 for Chinese Patent Application No. 200580051839.7, Application Date Oct. 14, 2005.

* cited by examiner

*Primary Examiner* — An Do
*Assistant Examiner* — Renee I Wilson
(74) *Attorney, Agent, or Firm* — HP Inc. Patent Department

(57) ABSTRACT

The invention relates to an ink cartridge comprising a liquid ink, an extraction system for the liquid ink and a container for the liquid ink, the container having a non zero water vapor transmission rate, the liquid ink occupying a first region 411 of the container, the ink cartridge further comprising a second liquid, the second liquid occupying a second region 421 of the container, whereby the first and the second region are separated, and whereby the extraction system is in communication with the first region but is not in communication with the second region.

12 Claims, 2 Drawing Sheets

INK CARTRIDGE

FIELD OF THE INVENTION

The invention relates to the field of ink cartridges such as the ink cartridges used in printers.

BACKGROUND OF THE INVENTION

Ink cartridges are now widely used in printers. The ink is typically provided in a liquid form and, instead of refilling a dedicated reservoir, the common practice is to replace a cartridge containing the ink. The use of such cartridges avoids the user having to pour ink directly into an ink container which could lead to ink spillage. Such cart ridges are typically disposable, which has consequences on the design and on the cost of the container. Additionally, ink is valuable, and as such its evaporation should be avoided both during use or while a cartridge sits on a shelf in a shop for example. The design of ink cartridges should take these various factors into account.

PRIOR ART

A large variety of ink cartridges exists as disclosed for example in U.S. Pat. No. 5,467,117, in EP0953449 or in U.S. Pat. No. 6,454,387. In existing cartridges, the ink is placed in a container, the container typically comprising two parts, one of which being a lid. Such a two parts container is normally not completely tight, and allows some degree of evaporation of its content. This leads to ink losses which, in extreme cases, may even reduce the cartridge shelf life significantly. Tightness is normally taken into account when designing such a cartridge, with the aim of maximizing it. The object of the invention is to reduce ink losses due to evaporation.

SUMMARY OF THE INVENTION

This object is achieved in a first aspect of the invention by an ink cartridge comprising a liquid ink, an extraction system for the liquid ink and a container for the liquid ink, the container having a non zero water vapor transmission rate, the liquid ink occupying a first region of the container, the ink cartridge further comprising a second liquid, the second liquid occupying a second region of the container, whereby the first and the second region are separated, and whereby the extraction system is in communication with the first region but is not in communication with the second region.

The ink cartridge according to the invention allows a reduction of the ink losses by evaporation using the following mechanism: the water vapor transmission rate of the container being a constant, the vapor is formed of the liquid contained in the container. If the only liquid contained in the container is the liquid ink, the liquid ink will contribute fully to the evaporation. If, according to the invention, a second liquid is provided, this second liquid will also contribute to evaporation, this contribution of the second liquid counter balancing the contribution of the liquid ink and thereby reducing it. Instead of focusing on avoiding evaporation, the evaporation of the liquid ink is reduced and compensated by introducing the second liquid.

The invention relates to an ink cartridge. In an embodiment, the ink cartridge is disposable.

The cartridge comprises a liquid ink. In an embodiment, the cartridge comprises a plurality of liquid inks, each ink having a color different from any other ink. The cartridge comprises an extraction system. In an embodiment, the extraction system is based on capillarity. In an embodiment, the extraction system comprises a plurality of nozzles. In another embodiment, the extraction system comprises a plurality of nozzles, the nozzles being fired using thermal ink jet technology involving electrical heating of the ink to produce a drop of ink fired through a nozzle onto a printing media. In another embodiment, the extraction system comprises a plurality of nozzles, the nozzles being fired using piezo technology to produce a drop of ink to be fired through a nozzle onto a printing media.

The cartridge comprises a container. In an embodiment, the container comprises a container lid and a container body. In an embodiment, the container has a first end and a second opposite end, the container comprising a container lid on its first end, the extraction system being located in the region of the second opposite end.

The container has a non zero water vapor transmission rate. This should be understood as a non zero water vapor transmission rate at 38 degrees Celsius and 90% RH. In an embodiment, the container has a water vapor transmission rate of at least 0.1 mg per 24 hours per 6.45 cm2 at 38 degrees Celsius and 90% RH which means that the container allows for an escape of at least 0.1 mg of vapor per day and per 6.25 cm2 (or about 1 in2) when placed in an atmosphere at 38 degrees Celsius (or about 100 degrees Fahrenheit) at 90% relative humidity. The water vapor transmission rate of the container is a manner of representing or measuring the quantity of vapor which escapes from the inside of the container towards the outside of the container when the container is do sed, which is considered as being the case when the cartridge has completed its manufacturing process. Typically, the container is made of plastic material or thermoplastic resins. Typically, vapor is likely to escape either directly through the material forming the container or at the interface between parts of the container (if the container comprises several parts) or at the interface between the container and the extraction system.

The container comprises a first and a second region. In an embodiment of the first aspect, the first and the second region are separated by a wall. In an embodiment, the first and the second regions are a first and a second cavity respectively, the first cavity being filled with liquid ink, the second cavity being filled with another liquid, the first and the second region being separated so that the liquid ink and the other liquid do not mix. In an embodiment of the first aspect, the first and the second region are formed of a porous material.

The extraction system is in communication with the first region. In an embodiment, communication is by capillarity. The extraction system is not in communication with the second region. In an embodiment, the first region is located between the second region and the extracting system. In an embodiment, the first region is located between the second region and the extracting system and a third region is located between the first and the second region, the third region being liquid free. In an embodiment, the extracting system is separated from the second region by a wall. In an embodiment, the extraction system is separated from the second region by an empty cavity. In an embodiment, the extraction system is separated from the second region by a sealing member.

This object is achieved in a second aspect of the invention by an ink cartridge comprising a container, a porous material and a liquid ink, the porous material being located inside the container, the liquid ink occupying a first region of the porous material, the ink cartridge further comprising a second liquid, the second liquid occupying a second region of the porous material, whereby a third region of the porous material is free of the liquid ink and free of the second liquid, the third region separating the first and the second region from each other.

According to the second aspect, the cartridge comprises a porous material. The porous material is placed inside the container. The porous material contains the first and the second liquid separated. Use of such a porous material typically facilitates controlling the debit of ink extracted from the cartridge. In an embodiment, the porous material is a sponge material. In an embodiment, the porous material is cellulose based. In an embodiment, the porous material in made of thermoplastic resins. In an embodiment, the porous material is made of woven or non woven fibers. In an embodiment, the porous material is made of natural material. In an embodiment, the porous material is made of a polymer.

In an embodiment of the first or of the second aspect of the invention, the second liquid is colorless. In an embodiment, the second liquid is water. In an embodiment, the second liquid is less costly than the liquid ink.

In an embodiment of the second aspect of the invention, the porous material has a first side and an opposite second side, whereby the first region includes part of the first side and the second region includes part of the second side.

In an embodiment of the first or of the second aspect of the invention, the second region has a volume larger than the volume of the first region.

In an embodiment of the first or of the second aspect of the invention, the second region has a volume larger or equal than the volume of the first region.

In an embodiment of the first or of the second aspect of the invention, the second region has a volume equal to the volume of the first region.

In an embodiment of the first or of the second aspect of the invention, the second liquid is more volatile than or at least as volatile as the liquid ink at ambient temperature.

In an embodiment of the invention, the cartridge is submitted to a total evaporation, the contribution of the second liquid to the total evaporation being larger than the contribution of the liquid ink to the total evaporation.

In an embodiment of the invention, the cartridge is submitted to a total evaporation, the contribution of the second liquid to the total evaporation being equal to the contribution of the liquid ink to the total evaporation.

In an embodiment of the invention, the cartridge is submitted to a total evaporation, the contribution of the liquid ink to the total evaporation being larger than the contribution of the second liquid to the total evaporation.

In an embodiment, a third liquid is provided, the third liquid further contributing to the total evaporation. In another embodiment, a further plurality of liquids is provided, each of the liquids contributing to the total evaporation.

In an embodiment of the second aspect of the invention, the porous material is an integral piece of porous material. By integral it should be understood that the porous material is made out of only one piece of porous material. In another embodiment, the porous material is made out of two or more pieces. In another embodiment, the porous material is made out of two or more pieces, at least two of these pieces being separated, whereby the first and the second regions are located in separated pieces. In another embodiment, the porous material is made out of two or more pieces, whereby the first and the second regions are located in different pieces. In a case of having the first and the second region in the same piece of porous material or in different pieces of porous material which have some point or zone of contact, the invention will have the additional effect of having the second liquid releasing the backpressure onto the liquid ink in the porous material. In order to understand this phenomenon and its consequences, let us consider a cartridge according to the state of the art comprising one porous material with liquid ink and an extraction system in contact with the porous material. In this prior art example, the extraction system will absorb the liquid ink located in its direct vicinity in the zone of porous material in contact with the extraction system. While the liquid ink is being extracted from this zone, the concentration of ink in this zone will tend to reduce, while the concentration of ink in other zones of the porous material will tend to remain constant. This state will continuously evolve, whereby the ink will tend to move into the zone of low concentration so that a new equilibrium may be obtained tending to a uniform liquid ink distribution in the material. This allows replenishing the zone of porous material in contact with the extraction system continuously. It should however be noted that towards the end of its life, as the concentration of liquid ink lowers, it would be advantageous to concentrate the ink in the zone of porous material in contact with the extraction system continuously, rather than dilute it continuously over the whole volume of porous material. This may be obtained by lowering the back pressure applied onto the liquid ink in the porous material, a lower back pressure ensuring a higher concentration of ink in the zone of porous material in contact with the extraction system compared to the rest of the porous material. This may for example be obtained by having a non uniform design of the porous material itself, the porous material presenting zone s having different capillarity. In the invention, in a case of having the first and the second region in the same piece of porous material or in different pieces of porous material which have some point or zone of contact, the invention will have the additional effect of having the second liquid decreasing the backpressure in the porous material, particularly if this second liquid is located towards an end opposed to the end of the porous material in contact with the extraction system. This would lead to use the liquid ink more efficiently and "empty" the cartridge better. This effect may be combined with a variation of the characteristics of the porous material or with other known technical features leading to the same effect.

In an embodiment, the respective positioning of the second liquid and of the liquid ink is such that, when the cartridge is placed into a printer for use in a normal position, the second liquid is not directly placed above the liquid ink, this in order to further reduce contamination risks by avoiding or reducing migration of the second liquid towards the liquid ink by gravity. In an embodiment, the respective positioning of the second liquid and of the liquid ink is such that, when the cartridge is placed into a printer for use in a normal position, the second liquid placed on the side of the liquid ink. In an embodiment, the respective positioning of the second liquid and of the liquid ink is such that, when the cartridge is placed into a printer for use in a normal position, the second liquid placed on a diagonally opposed position of a porous material in relation to the liquid ink.

In an embodiment, the liquid ink is comprised in a porous material and the second liquid is comprised in a separated empty compartment. Empty should be understood as empty from porous material.

In an embodiment, the second liquid is comprised in a porous material and the liquid ink is comprised in a separated empty compartment. Empty should be understood as empty from porous material.

It should be understood that the backpressure corresponds, in the sense of this invention, to a pressure which pulls the liquid ink away from the extraction system. It should therefore be understood that such backpressure should be maintained as low as possible.

In an embodiment of the first or of the second aspect of the invention, the container has a water vapor transfer rate of at least 0.1 mg per 24 hours per 6.45 cm2 at 38 degrees Celsius and 90% RH and of less than 1 g per 24 hours per 6.45 cm2 at 38 degrees Celsius and 90% RH. In another embodiment the complete cartridge has an outer surface of at least 5000 mm2 and of less than 7000 mm2, whereby the complete cartridge exhibits a water vapor transfer of at least 0.5 mg and of less than 2.7 mg per day per complete cartridge at 25 degrees Celsius at 70% RH (Relative Humidity). In another embodiment the complete cartridge has an outer surface of at least 4000 mm2 and of less than 8000 mm2, whereby the complete cartridge exhibits a water vapor transfer of at least 0.1 mg and of less than 5 mg per day per complete cartridge at 25 degrees Celsius at 70% RH (Relative Humidity). In another embodiment the complete cartridge has an outer surface of at least 5500 mm2 and of less than 6500 mm2, whereby the complete cartridge exhibits a water vapor transfer of at least 1.5 mg and of less than 2 mg per day per complete cartridge at 25 degrees Celsius at 70% RH (Relative Humidity).

This object is achieved in a third aspect of the invention by a process of manufacturing an ink cartridge comprising:

providing an integral porous material;

injecting a liquid ink in a first region of the porous material;

injecting a second liquid in a second region of the porous material;

whereby the first region and the second region do not intersect.

According to the invention, a contamination of the liquid ink by the second liquid is avoided. In this aspect, this is provided by ensuring that the first region and the second region do not intersect. This may be achieved for example by tuning the volume of liquid ink and/or the volume of the second liquid injected taking into account the total volume of liquid which may be absorbed by the integral porous material and the properties of such material. In an embodiment, the integral porous material has a maximum liquid volume absorbing capacity, whereby the addition of the volume of liquid ink injected and of the volume of second liquid injected represents less than 90% of the maximum liquid volume absorbing capacity. In an embodiment, the integral porous material has a maximum liquid volume absorbing capacity, whereby the addition of the volume of liquid ink injected and of the volume of second liquid injected represents less than 75% of the maximum liquid volume absorbing capacity. In an embodiment, the integral porous material has a maximum liquid volume absorbing capacity, whereby the addition of the volume of liquid ink injected and of the volume of second liquid injected represents less than 60% of the maximum liquid volume absorbing capacity. In an embodiment, the integral porous material has a maximum liquid volume absorbing capacity, whereby the addition of the volume of liquid ink injected and of the volume of second liquid injected represents less than 50% of the maximum liquid volume absorbing capacity In an embodiment of the third aspect of the invention, the liquid ink is injected on one side of the porous material, the second liquid being injected on an opposite side of the porous material.

In an embodiment of the third aspect of the invention, the volume of liquid ink injected is lower than the volume of second liquid injected.

In an embodiment of the third aspect of the invention, the volume of liquid ink injected is the same as the volume of second liquid injected.

In an embodiment of the third aspect of the invention, the volume of liquid ink injected is higher than the volume of second liquid injected.

This object is achieved in a fourth aspect of the invention by a method of extracting liquid from an ink cartridge according to any of the first or second aspect of the invention, whereby the liquid is extracted out of the cartridge from the first region only. In an embodiment of the fourth aspect, the second liquid is not used for printing.

This object is achieved in a fifth aspect of the invention by a used ink cartridge comprising traces of a liquid ink, an extraction system and a container, the container having a non zero water vapor transmission rate, the traces of the liquid ink occupying a first region of the container, the ink cartridge further comprising a second liquid, the second liquid occupying a second region of the container, whereby the first and the second region are separated, whereby the extraction system is in communication with the first region but is not in communication with the second region. According to this aspect, the cartridge may not be used for printing anymore. It should be noted that such a used cartridge may be refilled in ink. It should be noted that during use, the liquid ink is extracted from the cartridge for printing, whereas the second liquid is not, so that the relative proportion of second liquid in the cartridge increases in comparison to the proportion of liquid ink. It should be noted that when empty of liquid ink, liquid ink traces will remain in the cartridge.

In an embodiment of the fifth aspect of the invention, the liquid ink comprises at least two components, whereby one of the at least two components is a solvent, and whereby the solvent has evaporated.

In an embodiment of the fifth aspect of the invention, the second liquid is present as a trace. In this particular embodiment, the second liquid may have evaporated totally.

This object is achieved in a sixth aspect of the invention by a method of conserving an ink cartridge comprising:

providing an ink cartridge comprising a liquid ink and a container for the liquid ink, the container having a non zero water vapor transfer rate;

limiting the ink losses due to the water vapor transfer rate of the container by providing a second liquid into the container, whereby the second liquid is not an ink.

In an embodiment, between at least 3 cm3 and less than 45 cm3 of liquid ink are injected in a cartridge according to the invention.

DETAILED DESCRIPTION

Figure 1:
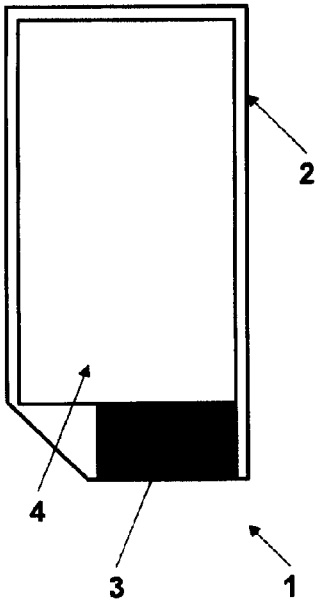
FIG. 1 is a section view of a first cartridge empty before being filled for the first time.
Figure 2:
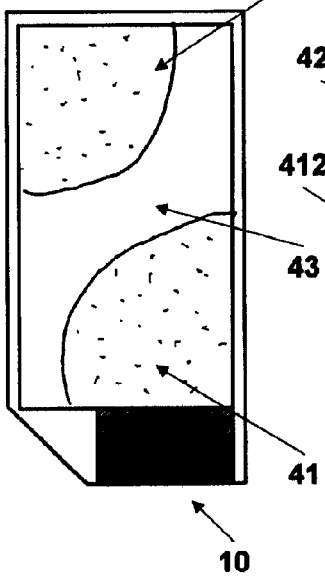
FIG. 2 is a section view of the cartridge of FIG. 1 after filling.
Figure 3:
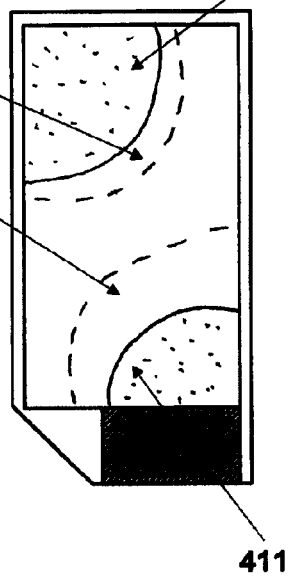
FIG. 3 is a section view of the cartridge of FIG. 2 during use.
Figure 4:
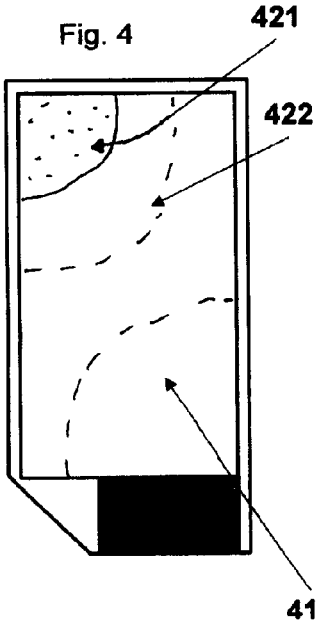
FIG. 4 is a section view of the cartridge of FIG. 3 when empty of liquid ink.
Figure 5:
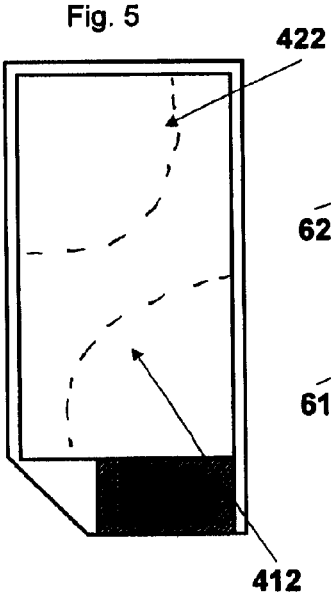
FIG. 5 is a section view of the cartridge of FIG. 4 when empty of the second liquid and of the liquid ink.

A first cartridge is represented in FIG. 1. The cartridge 1 comprises the container 2, the extraction mechanism 3 and a porous material 4. In an embodiment, the porous material is a parallelepiped having the following dimensions: a width of 20 mm, a length of 40 mm and being 30 mm broad. This cartridge is schematically represented empty in FIG. 1. This cartridge comprises a lid which is not represented and which is opened prior to filling the cartridge. This cartridge is being filled with a second liquid and with the liquid ink, filling occurring using a first tubular needle which is inserted in a first region of the porous material to inject liquid ink and a second tubular needle which is inserted in a second zone of the porous material to inject the second liquid. In this embodiment, about 5 cm3 of liquid ink and about 5 cm3 of water are injected. Once filled, this cartridge has a water vapor transmission rate. In this example, the porous material is a one piece integral porous material. The lid is placed after filling the cartridge. The filled cartridge 10 is represented in FIG. 2. The porous material is divided in a first region 41 comprising liquid ink, a second region 42 comprising the second liquid and a third region 43 which neither comprise liquid ink nor the second liquid. In this example, the second liquid is water. In this example, the volume of water injected is larger than the volume of liquid ink injected. In this example, the water releases the backpressure so that the liquid ink is being "pushed" towards the extraction system. The liquid ink passes to the extraction system by capillarity. The same cartridge is represented in FIG. 3 at some stage during use. The first region now comprises both a zone 411 comprising liquid ink and a zone 412 comprising traces of liquid ink. Similarly, the second region now comprises both a zone 421 comprising the second liquid and a zone 422 comprising traces of the second liquid. It should be noted that the zone 422 is relatively reduced compared to the zone 412, due to the fact that the liquid ink gets extracted and evaporates creating zone 412, whereas the second liquid only evaporates creating zone 422. If the filled cartridge was kept for a time before using it, both zones 422 and 412 would form by evaporation only and would have a relatively similar size. In FIG. 4, the same cartridge is represented when empty of liquid ink. It should be noted that the zone 411 disappeared, so that the first region only comprises traces of liquid ink. The second liquid is however still present, as it was not being extracted. Still, the zone 422 has grown as evaporation of the second liquid has continued. In FIG. 5, this cartridge is represented completely empty when all of the second liquid evaporated, leaving only traces. It should be noted that the cartridge may be refilled with liquid ink and optionally with second liquid when the cartridge reaches the stage described in FIG. 4, or the stage described in FIG. 5, or at any stage in between these.

Figure 6:
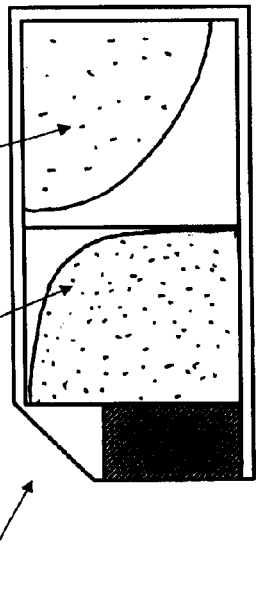
FIG. 6 is a section view of second cartridge.

In FIG. 6, a second cartridge 6 is represented just after having been filled. This cartridge differs from the cartridge of FIGS. 1 to 5 in that the porous material comprises 2 different parts 61 and 62 which are adjacent. This configuration allows choosing different characteristics for the different parts, for example. It would also be possible to place liquid tight separation between part 61 and 62. Such a separation would allow reducing or suppressing the zone equivalent to the region 43 separating the first and the second region and thereby increase the quantity of liquid contained in the cartridge, or reduce the size of the cartridge at a define liquid content, while ensuring that the second liquid does not contaminate the liquid ink.

Figure 7:
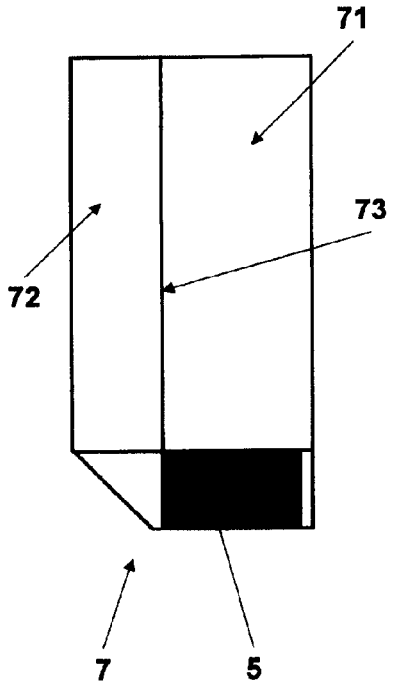
FIG. 7 is a section view of a third cartridge empty before being filled for the first time.
Figure 8:
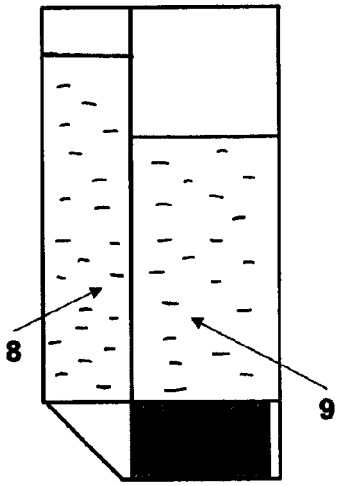
FIG. 8 is a section view of the cartridge of FIG. 7 after filling.
Figure 9:
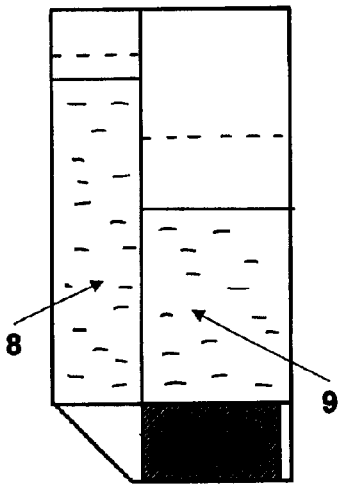
FIG. 9 is a section view of the cartridge of FIG. 8 during use.
Figure 10:
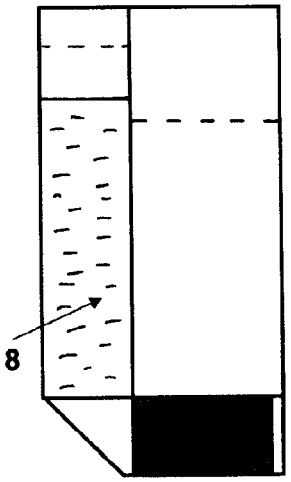
FIG. 10 is a section view of the cartridge of FIG. 9 when empty of liquid ink.
Figure 11:
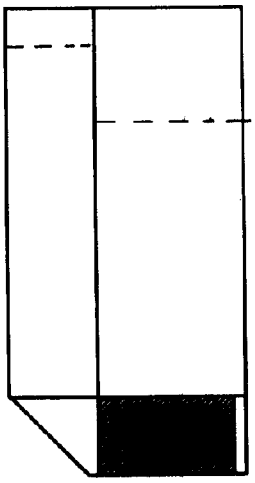
FIG. 11 is a section view of the cartridge of FIG. 10 when empty of the second liquid and of the liquid ink.

In FIG. 7, a cartridge 7 is represented prior to filling for the first time. The cartridge differs from the cartridge represented in FIG. 1 in that it does not comprise a porous material but comprises independent compartments 71 and 72. First compartment 71 is in communication with the extraction system 5. Compartments 71 and 72 are separated by a wall 73. The second compartment 72 is filled by a second liquid 8, in this case water, and the first compartment 71 by a liquid ink 9, to obtain the cartridge as represented in FIG. 8. The second compartment is separated from the extraction system 5. During use, the quantity of the liquid ink diminishes due to both evaporation and use for printing, whereas the quantity of second liquid reduces significantly less as it is not extracted but only evaporates. Such an evolution is represented in FIG. 9. FIG. 10 represents a cartridge empty of ink, and FIG. 11 a cartridge not only empty of ink but also where all of the second liquid evaporated. Similarly to the example detailed in FIGS. 1 to 5, traces of the liquid will remain, in particular on the walls of the compartments. In another embodiment, the liquid ink is a mixture of an ink vehicle and ink pigments, the second liquid having same composition as the ink vehicle, or a composition close to the composition of the ink vehicle, or a composition comprising ingredients of the ink vehicle, in order to minimize the consequences of a contamination of the liquid ink by the second liquid.

Figure 12:
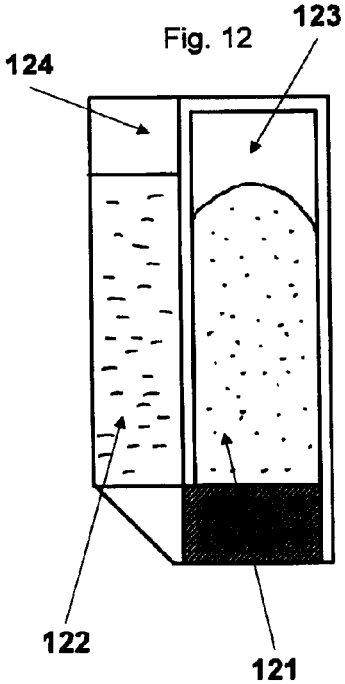
FIG. 12 is a section view of a fourth cartridge.

In FIG. 12, another cartridge configuration for realizing the various aspects of the invention is represented just after having been filled, where the second liquid 122 is comprised in a compartment 124, whereas the first liquid 121 is comprised in a porous material 123.

In FIGS. 3 to 5 and 9 to 11, the dashed lines represent the original filling level or filling limit, which corresponds to the limit of the remaining traces of the liquid concerned.

The present invention having thus been described with particular reference to the preferred forms thereof, it will be obvious that various changes and modifications may be made therein without departing from the scope of the present invention as defined in the appended claims.

The invention claimed is:

1. An ink cartridge, comprising:

a container comprising a first region containing a liquid ink and a second region containing a non-ink liquid, wherein the first and second regions of the container are separated by a liquid-free region to prevent mixing of the liquid ink and the non-ink liquid, and the container allows vapor resulting from evaporation of the liquid ink and the non-ink liquid in the container to escape from the container at a non-zero vapor transmission rate; and a single extraction mechanism for extracting the liquid ink from the first region of the container, wherein the extraction mechanism is adjacent and in direct fluid communication with the first region and is separated from and not in direct fluid communication with the second region.

2. An ink cartridge according to claim 1, wherein the first and the second regions are separated by a wall.

3. An ink cartridge according to claim 1, wherein the first and the second regions are formed of a porous material that absorbs the liquid ink and the non-ink liquid.

4. An ink cartridge, comprising:

a container containing a liquid-absorbing porous material, a liquid ink absorbed in a first region of the porous material, and a non-ink liquid absorbed in a second region of the porous material that is separated from the first region of the porous material by a third region of the porous material that is free of the liquid ink and free of the non-ink liquid, wherein the container allows vapor resulting from evaporation of the liquid ink and the non-ink liquid in the container to escape from the container at a non-zero vapor transmission rate.

5. An ink cartridge according to claim 4, wherein the second liquid is colorless.

6. An ink cartridge according to any of claim 4 or 5, wherein the porous material has a first side and an opposite second side, and the first region includes part of the first side and the second region includes part of the second side.

7. An ink cartridge according to claim 4, wherein the second region has a volume larger than the first region.

8. An ink cartridge according to claim 4, wherein the second liquid is at least as volatile as the liquid ink at ambient temperature.

9. An ink cartridge according to claim 4, wherein the porous material is an integral piece of porous material.

10. An ink cartridge according to claim 4, wherein the container allows vapor resulting from evaporation of the liquid ink and the non-ink liquid in the container to escape from the container at a water vapor transfer rate of at least 0.1 mg per 24 hours per 6.45 cm2 at 38 degrees Celsius and 90% RH and of less than 1 g per 24 hours per 6.45 cm2 at 38 degrees Celsius and 90% RH.

11. A method, comprising:

receiving an ink cartridge comprising a container, wherein the container comprises a first region containing a liquid ink, a second region containing a non-ink liquid, and a single extraction mechanism for extracting liquid from the container, the first and second regions of the container are separated by a liquid-free region to prevent mixing of the liquid ink and the non-ink liquid, the extraction mechanism is adjacent and in direct fluid extraction communication with the first region and is separated from and not in direct fluid extraction communication with the second region, and the container allows vapor resulting from evaporation of the liquid ink and the non-ink liquid in the container to escape from the container at a non-zero vapor transmission rate; and extracting the liquid ink from the first region of the container through the single extraction mechanism.

12. A method, comprising:

receiving an ink cartridge comprising a container containing a liquid-absorbing porous material, a liquid ink absorbed in a first region of the porous material, and a non-ink liquid absorbed in a second region of the porous material that is separated from the first region of the porous material by a third region of the porous material that is free of the liquid ink and free of the non-ink liquid, wherein the container allows vapor resulting from evaporation of the liquid ink and the non-ink liquid in the container to escape from the container at a non-zero vapor transmission rate; and extracting the liquid ink from the container through an extraction mechanism that is adjacent and in direct capillary communication with the first region and is separated from and not in direct capillary communication with the second region.

* * * * *